United States Patent [19]

Aono et al.

[11] Patent Number: 4,639,407

[45] Date of Patent: Jan. 27, 1987

[54] HEAT-DEVELOPABLE LIGHT-SENSITIVE MATERIAL USED IN SILVER SALT TRANSFERS

[75] Inventors: Toshiaki Aono; Hiroshi Hara, both of Kanagawa, Japan

[73] Assignee: Fuji Photo Film Co., Ltd., Kanagawa, Japan

[21] Appl. No.: 712,499

[22] Filed: Mar. 18, 1985

[30] Foreign Application Priority Data

Mar. 16, 1984 [JP] Japan ..... 59-50658

[51] Int. Cl.[4] ..... G03C 5/54

[52] U.S. Cl. ..... 430/203; 430/230

[58] Field of Search ..... 430/203, 617, 619, 620

[56] References Cited

U.S. PATENT DOCUMENTS

| | | | |
|---|---|---|---|
| 3,379,532 | 4/1968 | Wendt | 430/203 |
| 3,438,776 | 4/1969 | Yudelson | 430/203 |
| 3,694,204 | 9/1972 | Farney et al. | 430/203 |
| 4,452,885 | 6/1984 | Nozawa et al. | 430/619 |
| 4,476,220 | 10/1984 | Penfound | 430/619 |
| 4,503,137 | 5/1985 | Sawada et al. | 430/203 |

FOREIGN PATENT DOCUMENTS

| | | | |
|---|---|---|---|
| 1045588 | 10/1966 | United Kingdom | 430/203 |

*Primary Examiner*—Richard L. Schilling

*Attorney, Agent, or Firm*—Sughrue, Mion, Zinn, Macpeak and Seas

[57] ABSTRACT

A heat-developable light-sensitive material containing a light-sensitive silver halide and an organic silver salt oxidizing agent is disclosed. The material can image-wise produce a movable silver salt under a high temperature condition in the presence of a reducing agent and a silver halide solvent.

12 Claims, No Drawings

HEAT-DEVELOPABLE LIGHT-SENSITIVE MATERIAL USED IN SILVER SALT TRANSFERS

FIELD OF THE INVENTION

This invention relates to a heat-developable light-sensitive material and, more particularly, to a heat-developable light-sensitive material which can form a positive image by heating without using a chemical developing solution.

BACKGROUND OF THE INVENTION

Conventionally known photographic techniques involving use of a silver salt for image formation include a silver salt diffusion transfer reversal process.

According to the silver salt diffusion transfer reversal process, the photographic film unit generally comprises a negative sheet that is a light-sensitive material consisting mainly of silver halides and a positive sheet. After the negative sheet is exposed to light, the exposed emulsion surface is brought into contact with a positive sheet, and the combined unit is immersed in a developing solution and squeezed by rollers to press excessive solution out. After allowing the unit to stand for a certain period of time, silver halides of the negative sheet in the sufficiently exposed areas are developed by the action of the developing solution, while silver halides in the unexposed areas are solubilized by the action of a silver halide solvent and are thereby diffused and transferred into the positive sheet, in which the solubilized silver halides are reduced to silver to form a positive image.

The above-described technique gives rise to problems ascribed to the use of a developing solution containing an alkali, such as contamination of hands or clothes and corrosion of devices. In addition, this method requires skill in handling or maintenance of chemicals for the developing solution.

In order to overcome these disadvantages, various systems for easily forming positive images only by heat have been proposed.

It is considerably difficult to solubilize silver halides only by heating in the presence of a silver halide solvent. Therefore, solubilization of silver halides was attempted by using silver halides containing at least 80 mol % of silver chloride, as disclosed, e.g., in Japanese Patent Publication No. 18667/66. However, emulsions comprising silver chloride for the most part are generally low in sensitivity and are not sufficiently applicable to a practical use.

SUMMARY OF THE INVENTION

Accordingly, an object of this invention is to provide a photographic light-sensitive material which can easily form a silver image, particularly a positive silver image, only by heating.

Another object of this invention is to provide a heat-developable photographic light-sensitive material having high sensitivity, which is suitable for a silver salt diffusion transfer reversal process.

These objects of this invention can be accomplished by a heat-developable light-sensitive material containing light-sensitive silver halides and an organic silver salt oxidizing agent, which can imagewise form a heat-movable silver salt under a high temperature condition in the presence of a reducing agent and a silver halide solvent.

DETAILED DESCRIPTION OF THE INVENTION

According to the light-sensitive material of the present invention, heating an exposed material in the presence of a reducing agent imagewise produces silver areas and silver halide areas, and the silver halides react with a silver halide solvent to thereby form a silver salt which is movable at high temperatures and is negative to a silver image.

The movable silver salt is diffused in a silver salt-fixing layer having a silver precipitant and is thereby visualized to obtain an image negative to the silver image.

In a preferred embodiment in which the heat-developable light-sensitive material according to the present invention is used, a light-sensitive material containing light-sensitive silver halides and an organic silver salt oxidizing agent is heated in the presence of a reducing agent and a silver halide solvent to form a movable silver salt image which is negative to a silver image, and the movable silver salt is diffused in a silver salt-fixing layer containing a silver precipitant at high temperatures, thereby forming a silver image corresponding to the movable silver salt image in said fixing layer.

In this embodiment, a silver salt-fixing material containing a silver salt-fixing layer may be provided on either a sheet different from the light-sensitive material having a light-sensitive layer or the same sheet as the light-sensitive material via an intermediate layer or a reflecting layer, such as titanium oxide.

Moving of the movable silver salt may be carried out simultaneously with the process of silver salt formation, or may be effected by heating the light-sensitive material after the formation of the movable silver salt with the silver salt-fixing material being superposed thereon.

The reaction for forming the heat-movable silver salt can be carried out in a film substantially free from water at high temperatures.

The term "high temperatures" as herein used means temperatures of 80° C. and higher. The term "substantially free from water" as herein used means such a state that is in equilibrium with moisture in air but does not draw any water from outside of the system. Such a state is described in T. H. James (ed.), *The Theory of the Photographic Process*, 4th Ed., 374, Macmillan. It is confirmed that a sufficinet reaction can be achieved even in a dry state containing substantially no water from the fact that the reaction rate of a sample is not reduced even after being vacuum-dried at $10^{-3}$ mmHg for one day.

A mixture of two or more emulsions can be used in the photographic emulsion layer of the photographic light-sensitive material of the present invention. In this case, silver halides which can be used may be any of silver bromide, silver iodobromide, silver iodochlorobromide, silver chlorobromide and silver chloride. The preferred silver halide is silver iodobromide containing not more than 15 mol % of silver iodide. The most preferred is silver iodobromide containing from 2 to 12 mol % of silver iodide.

A mean grain size of silver halide grains in the photographic emulsion (the grain size being defined as grain diameter if the grain has a spherical or a nearly spherical form and as a length of the edge if the grain has a cubic form, and being averaged based on projected areas of the grains) is not particularly restricted, but is preferably 3 μm or less.

Grain size distribution may be either narrow or broad.

Silver halide grains in the photographic emulsion may have a regular crystal form, such as a cube and an octahedron, an irregular crystal form (e.g., spherical or tubular forms), or a composite form thereof. Silver halide grains may also be a mixture of grains having various crystal forms.

Emulsions containing tabular silver halide grains having a diameter to thickness ratio of 5 or more in the proportion of 50% or more based on the total projected areas may also be used.

The individual silver halide grains may be homogeneous or may comprise a core and an outer shell having different phases. Further, they may be grains where a latent image is predominantly formed on the surface thereof, or may be grains where a latent image is predominantly formed in the interior thereof.

Photographic emulsions which can be used in the present invention can be prepared according to conventional methods as described, e.g., in P. Glafkides, *Chimie et Physique Photographique,* Paul Montel (1967), G. F. Duffin, *Photographic Emulsion Chemistry,* The Focal Press (1966), V. L. Zelikman et al., *Making and Coating Photographic Emulsion,* The Focal Press (1964), etc. That is, photographic emulsions can be prepared in accordance with any of the acid process, the neutral process, the ammonia process, and the like. Methods for reacting a water-soluble silver salt with a water-soluble halide include a single jet method, a double jet method, a combination thereof, and the like.

In addition, a method in which silver halide grains are produced in the presence of excess silver ions (the so-called reverse mixing method) can also be employed. Further, the so-called controlled double jet method, in which the pAg of the liquid phase wherein silver halide grains are to be precipitated is maintained constant, may be employed. According to this method, silver halide emulsions in which grains have a regular crystal form and an almost uniform size distribution can be obtained.

In the formation of silver halide grains or the physical ripening of the produced silver halide grains, cadmium salts, zinc salts, lead salts, thallium salts, iridium salts or complex salts thereof, rhodium salts or complex salts thereof, iron salts or complex salts thereof, and the like may be present.

After the formation of silver halide grains or after physical ripening, soluble salts are usually removed from the silver halide emulsion by the conventionally known noodle washing method which comprises gelling the gelatin or by a sedimentation (flocculation) process using an inorganic salt composed of a polyvalent anion, e.g., sodium sulfate, an anionic surface active agent, an anionic polymer, e.g., polystyrenesulfonic acid, or a gelatin derivative, e.g., an aliphatic acylated gelatin, an aromatic acylated gelatin, an aromatic carbamoylated gelatin, etc.

The silver halide emulsion is usually subjected to chemical sensitization. Chemical sensitization can be carried out using processes as described, e.g., in H. Frieser (ed.), *Die Grundlagen der Photographischen Prozesse mit Silberhalogeniden,* 675–734, Akademische Verlagsgesellschaft (1968).

More specifically, chemical sensitization can be performed by sulfur sensitization using compounds containing sulfur capable of reacting with active gelatin or silver ions (e.g., thiosulfates, thioureas, mercapto compounds, rhodanines, etc.), reduction sensitization using reducing materials (e.g., stannous salts, amines, hydrazine derivatives, formamidine-sulfinic acid, silane compounds, etc.), noble metal sensitization using noble metal compounds (e.g., gold complexes, and complexes of Periodic Table Group VIII metals, such as Pt, Ir, Pd, etc.) and the like individually or as a combination thereof.

According to the present invention, when a usual negative emulsion is used, a silver image which is positive to an exposed image can be obtained, while when a direct positive emulsion is used, a silver image which is negative to an exposed image can be obtained.

The photographic emulsions which can be used in the present invention may be spectrally sensitized with methine dyes and others. Sensitizing dyes to be used include cyanine dyes, merocyanine dyes, complex cyanine dyes, complex merocyanine dyes, holopolar cyanine dyes, hemicyanine dyes, styryl dyes and hemioxonol dyes, with cyanine dyes, merocyanine dyes and complex merocyanine dyes being particularly useful. Any of the basic heterocyclic nuclei commonly employed in cyanine dyes may be used in these sensitizing dyes. For example, such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-enumerated nuclei having fused thereon an alicyclic hydrocarbon ring; and the above-enumerated nuclei having fused thereon an aromatic hydrocarbon ring, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have a substituent on their carbon atoms.

Nuclei having a ketomethylene structure can be used in merocyanine dyes or complex merocyanine dyes. Such nuclei include 5- or 6-membered heterocyclic nuclei, such as a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus, and the like.

These sensitizing dyes may be used alone or in combinations thereof. Combinations of sensitizing dyes are frequently employed for the purpose of supersensitization.

The emulsion may contain a dye having per se no spectral sensitizing activity or a substance which does not substantially absorb visible light, which exhibits supersensitizing activity when used in combination with the sensitizing dye. Such a dye or substance includes, for example, aminostyryl compounds as described, e.g., in U.S. Pat. Nos. 2,933,390 and 3,635,721, aromatic organic acid-formaldehyde condensation products as described, e.g., in U.S. Pat. No. 3,743,510, cadmium salts, azaindene compounds, and the like.

It is also effective to sensitize the emulsion up to the infrared region (i.e., 700 nm or more).

Sensitizing dyes which are particularly effective in the present invention are those disclosed in Japanese Patent Application No. 55694/83 (U.S. patent application Ser. No. 595,222, filed Mar. 30, 1984).

The organic silver salt oxidizing agent which can be used in the present invention is such that it can be reduced to silver upon being heated to 80° C. or more, and preferably to 100° C., in the presence of exposed silver halides. Such an organic silver salt oxidizing agent includes silver salts of organic compounds having a carboxyl group, such as silver salts of aliphatic carboxylic acids, silver salts of aromatic carboxylic acids, and the like.

Specific examples of the aliphatic carboxylic acids are behenoic acid, stearic acid, oleic acid, lauric acid, capric acid, myristic acid, palmitic acid, maleic acid, fumaric acid, tartaric acid, furoic acid, linoleic acid, oleic acid, adipic acid, sebacic acid, succinic acid, acetic acid, lactic acid, camphoric acid, and the like. Silver salts of these aliphatic carboxylic acids substituted with a halogen atom or a hydroxyl group are also effective.

Examples of the aromatic carboxylic acids include benzoic acid; substituted benzoic acids, such as 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, etc.; gallic acid, tannic acid, phthalic acid, terephthalic acid, salicyclic acid, phenylacetic acid, pyromellitic acid, and the like. Silver salts of other carboxyl-containing compounds include silver salts of 3-carboxymethyl-4-methyl-4-thiazoline-2-thione, etc. as disclosed in U.S. Pat. No. 3,785,830; silver salts of aliphatic carboxylic acids having a thioether group as disclosed in U.S. Pat. No. 3,330,663; and the like.

In addition, silver salts of compounds containing a mercapto group or a thione group and their derivatives can also be employed.

Specific examples of these mercapto- or thione-containing compounds are 3-mercapto-4-phenyl-1,2,4-triazole, 2-mercaptobenzimidazole, 2-mercapto-5-aminothiadiazole, 2-mercaptobenzothiadiazole, 2-(s-ethylglycolamido)benzothiazole, thioglycolic acids as described, e.g., in Japanese Patent Application (OPI) No. 28221/73 (the term "OPI" as herein used means "unexamined published application"), such as s-alkylthioglycolic acids having from 12 to 22 carbon atoms in their alkyl moiety, dithiocarboxylic acids, such as dithioacetic acid, thioamides, 5-carboxyl-1-methyl-2-phenyl-4-thiopyridine, mercaptotriazine, 2-mercaptobenzoxazole, mercaptooxadiazole, compounds disclosed in U.S. Pat. No. 4,123,274, such as 3-amino-5-benzylthio-1,2,4-triazole that is a 1,2,4-mercaptotriazole derivative, thione compounds as described in U.S. Pat. No. 3,301,678, such as 3-(2-carboxyethyl)-4-methyl-4-thiazoline-2-thione, and the like.

Moreover, silver salts of compounds having an imino group can also be used. Examples of such compounds include benzotriazole and derivatives thereof as described in Japanese Patent Publication Nos. 30270/69 and 18416/70, such as alkyl-substituted benzotriazoles, e.g., methylbenzotriazole, etc., halogen-substituted benzotriazoles, e.g., 5-chlorobenzotriazole, etc., 4-hydroxybenzotriazole, 5-nitrobenzotriazole, carboimidobenzotriazoles, e.g., butylcarboimidobenzotriazole, etc., 1,2,4-triazole or 1-H-tetrazole as described in U.S. Pat. No. 4,220,709, carbazole, saccharin, imidazole and derivatives thereof, and the like.

The heat development mechanism when heating according to the present invention has not yet been established, but is believed to work follows.

When the light-sensitive material is exposed to light, a latent image is formed in the light-sensitive silver halide. For details of this latent image formation, reference can be made to T. H. James, *The Theory of the Photographic Process,* 3rd Ed., 105–148. By heating the light-sensitive material, the reducing agent reduces the silver halides and the organic silver salt oxidizing agent by the catalyzing activity of the latent image nuclei to thereby produce silver.

A coating solution can be prepared by mixing separately prepared silver halide and organic silver salt oxidizing agent before use, but it is also effective to mix both in a ball mill for a long time until use. A method in which a halogen-containing compound is added to an organic silver salt oxidizing agent to form a silver halide from the silver in the organic silver salt oxidizing agent and the halogen is also effective.

Methods for preparing these silver halides and organic silver salt oxidizing agents and methods for mixing them are described, e.g., in *Research Disclosure* No. 17029, Japanese Patent Application (OPI) Nos. 32928/75 and 42529/76, U.S. Pat. No. 3,700,458, Japanese Patent Application (OPI) Nos. 13224/74 and 17216/75, etc.

In the present invention, the light-sensitive silver halide and organic silver salt oxidizing agent are suitably coated in a total amount of from 50 mg to 10 g/m$^2$ as converted to silver.

The reducing agent which can be used in the present invention includes p-phenylene type color developing agents typically exemplified by N,N-diethyl-3-methyl-p-phenylenediamine, as described in U.S. Pat. No. 3,521,286, and aminophenol reducing agents, as described in U.S. Pat. No. 3,761,270. The preferred among the aminophenol reducing agents are 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, and the like. Further, the reducing agents described in *Research Disclosure,* No. 15108, U.S. Pat. No. 4,021,240, such as 2,6-dichloro-4-substituted sulfonamidophenols, 2,6-dibromo-4-substituted sulfonamidophenols, etc., are useful. In addition to the above-described phenol type reducing agents, naphthol type reducing agents, e.g., 4-aminonaphthol derivatives and 4-substituted sulfonamidonaphthol derivatives, are also useful. Furthermore, generally applicable color developing agents include aminohydroxypyrazole derivatives as disclosed, e.g., in U.S. Pat. No. 2,895,825, aminopyrazoline derivatives as disclosed, e.g., in U.S. Pat. No. 2,892,714, and hydrazone derivatives as disclosed, e.g., in *Research Disclosure* RD-19412 and RD-19415, 227–230 and 236–240 (June, 1980).

The reducing agent is preferably present on a support having provided thereon a silver halide emulsion layer, and more preferably in said silver halide emulsion layer or a layer adjacent thereto.

Other usable reducing agents include hydroquinone, alkyl-substituted hydroquinones, e.g., t-butylhydroquinone, 2,5-dimethylhydroquinone, etc.; catechols; pyrogallols; halogen-substituted hydroquinones, e.g., chlorohydroquinone, dichlorohydroquinone, etc.; alkoxy-substituted hydroquinones, e.g., methoxyhydroquinone, etc.; polyhydroxybenzene derivatives, e.g., methylhydroxynaphthalene, etc.; methyl gallate; ascorbic acid; ascorbic acid derivatives; hydroxylamines, e.g., N,N'-di-(2-ethoxyethyl)hydroxylamine, etc.; pyrazolidones, e.g., 1-phenyl-3-pyrazolidone, 4-methyl-4-hydroxymethyl-1-phenyl-3-pyrazolidone, etc.; reductones; hydroxytetronic acids; and the like.

The reducing agent is usually used in an amount of from about 0.1 to about 20 mols per mol of the total amount of silver halides and organic silver salt oxidizing agent.

The organic silver salt oxidizing agent is usually used in an amount of from 0.005 to 10 mols, preferably from 0.01 to 1 mol, per mol of the silver halide.

The silver halide solvent which can be used in the present invention includes sodium thiosulfate, sodium thiocyanate and those described in U.S. Pat. No. 2,543,181; and combinations of cyclic imides and nitrogen bases, e.g., a combination of a barbiturate or uracil and ammonia or an amine or combinations described in U.S. Pat. No. 2,857,274.

Further, 1,1-bissulfonylalkanes and their derivatives are also known and can be used as a silver halide solvent in the present invention.

Additional examples of the silver halide solvent to be used in the present invention are organic thioether derivatives disclosed in Japanese Patent Publication No. 11386/72, e.g., 1,8-dihydroxy-3,6dithiaoctane, 1,10-dithia-4,7,13,16-tetraoxacyclooctadecane, 2,2'-thiodiethanol, 1,17-di(N-ethylcarbamyl)-6,12-dithia-9-oxaheptadecane, 3,15-dioxa-6,9,12-trithioheptadecane, 6,9-dioxa-3,12-dithiatetradecane-1,14-diol, etc.; and the compounds of the following formula as described in Japanese Patent Application (OPI) No. 144319/78:

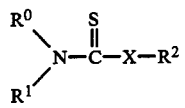

wherein X represents a sulfur atom or an oxygen atom; $R^0$ and $R^1$, which may be the same or different, each represents an aliphatic group, an aryl group, a heterocyclic group or an amino group; or $R^0$ and $R^1$ may be taken together to form a 5- or 6-membered hetero ring; and $R^2$ represents an aliphatic group or an aryl group; or $R^1$ and $R^2$ may be taken together to form a 5- or 6membered hetero ring.

Specific examples of the compounds of the above-described formula are shown below:

(1)

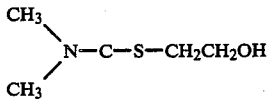

(2)

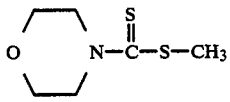

(3)

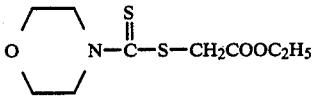

(4)

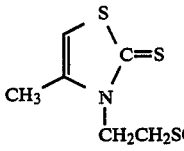

(5)

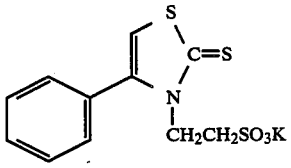

-continued (6)

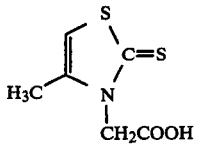

(7)

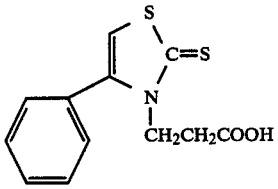

(8)

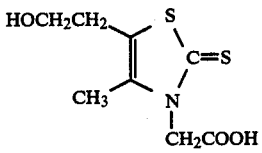

(9)

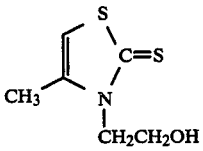

(10)

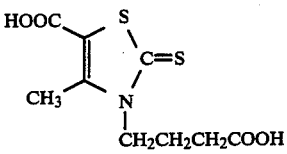

(11)

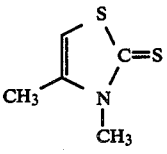

(12)

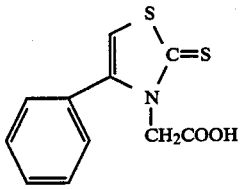

(13)

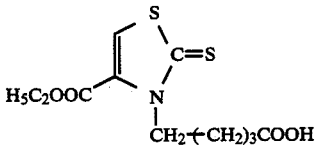

(14)

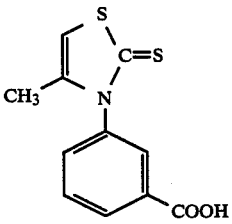

-continued (15)

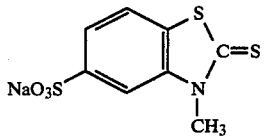

(16)

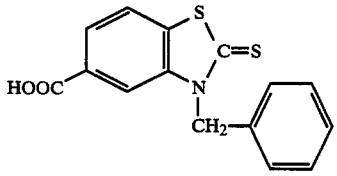

(17)

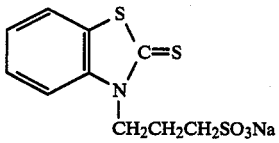

(18)

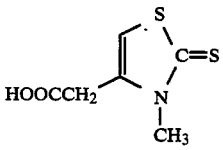

(19)

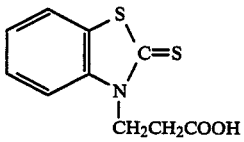

It is sufficient that the silver halide solvent takes part in the photographic system either simultaneously with or after the heating for development, but the silver halide solvent may be initially present together with the silver halides. Desirably, the silver halide solvent is incorporated into a separately prepared material having a silver salt fixing layer and, upon contact with the light-sensitive material, is supplied to the photographic system, preferably simultaneously with or after the heating for development.

The amount of the silver halide solvent to be used ranges from 1/20 to 20 mols, and preferably from 1/10 to 10 mols, per mol of silver coated.

In the present invention, it is preferable to use a hydrophilic thermal solvent for accelerating movement of a movable silver salt.

The hydrophilic thermal solvent is thought to assist the movable silver salt to move rapidly. In addition, the hydrophilic thermal solvent is required to have a melting point of from 40° to 250° C., preferably from 40° to 200° C., and more preferably from 40° to 150° C., in view of heat resistance or the like of the light-sensitive material.

The hydrophilic thermal solvent as used in the present invention is a compound which is solid at room temperature but liquefied by heating, and is defined to have an inorganicity/organicity value of 1 or more and water solubility of 1 or more. The terms "inorganicity" and "organicity" as herein used indicate concepts for predicting properties of compounds, and details therefor are given in *Kagaku no Ryoiki,* 11, 719 (1957).

The hydrophilic thermal solvent preferably has a small molecular weight, i.e., less than about 200, and more preferably less than about 100.

Since the function required for the hydrophilic thermal solvent is to only help the movement of the movable silver salt produced by heat development into the silver salt-fixing layer, the thermal solvent can be incorporated not only in the silver salt-fixing layer but partly in the light-sensitive material. An independent layer containing the hydrophilic thermal solvent may also be provided in an independent silver salt-fixing material having a silver salt-fixing layer. From the standpoint of increasing the movement efficiency of the silver salt into the movable silver salt-fixing layer, it is preferable to incorporate the hydrophilic thermal solvent in the silver salt-fixing layer and/or the adjacent layer.

The hydrophilic thermal solvent is usually dissolved in water and dispersed in a binder, but alcohols, e.g., methanol, ethanol, etc., may also be used for dissolution.

The amount of the hydrophilic thermal solvent to be used in the present invention ranges from 5 to 500% by weight, preferably from 20 to 200% by weight, and more preferably from 30 to 150% by weight, based on the total coverage of the light-sensitive material.

Examples of the hydrophilic thermal solvent which can be used in the present invention include ureas, pyridines, amides, sulfonamides, imides, alcohols, oximes, and other heterocyclic compounds.

These hydrophilic thermal solvents can be used alone or in combinations of two or more thereof. Taking precipitation into conideration during storage for a long period of time, a combination of two or more of these hydrophilic thermal solvents is preferred.

Specific examples of the usable hydrophilic thermal solvents are shown below:

(1)

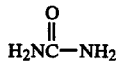

(2)

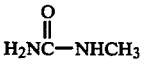

(3)

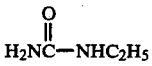

(4)

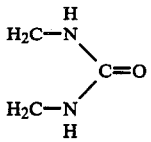

(5)

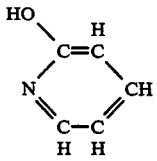

(6)

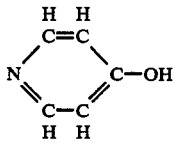

-continued

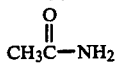
(7)

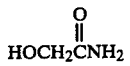
(8)

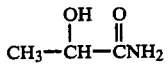
(9)

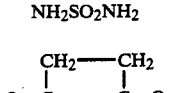
(10)

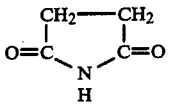
(11)

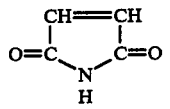
(12)

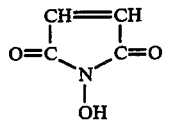
(13)

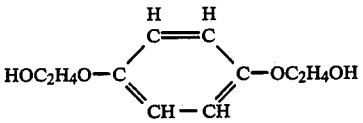
(14)

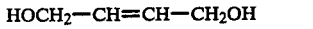
(15)

A light-sensitive layer (I) and a silver salt-fixing layer (II) ar generally provided on the same support, or on different supports to form a light-sensitive material and a silver salt-fixing material, respectively. The silver salt-fixing layer (II) and the light-sensitive layer (I) may be peeled away. For example, after a light-sensitive material is image-wise exposed to light and uniformly heat-developed, a silver salt-fixing layer (II) or the light-sensitive layer (I) can be peeled off. In the case where a light-sensitive material comprising a support having coated thereon a light-sensitive layer (I) and a silver salt-fixing material comprising a support having coated thereon a silver salt-fixing layer (II) are separately prepared, after the light-sensitive material is image-wise exposed to light and uniformly heated, the silver salt-fixing material is superposed thereon to thereby shift the movable silver salt to the silver salt-fixing layer (II). Further, a method in which only a light-sensitive material (I) is imagewise exposed to light and, then, a silver salt-fixing material (II) is superposed thereon, followed by uniformly heating, can also be used.

The silver salt-fixing layer (II) can have a white reflecting layer. For example, a layer of titanium dioxide dispersed in gelatin can be formed on a silver precipitant-containing layer provided on a transparent support. Such a titanium dioxide layer forms a white opaque layer and visualizes a transferred silver image as a reflection type silver image when seen from the side of the transparent sheet.

Adhesion of the light-sensitive material and silver image-fixing material can be effected by ordinary methods, such as a method of using press rollers. Sufficient adhesion can be ensured by heating.

According to the present invention, after heat-development is performed after or simultaneously with imagewise exposure, the surface layer of the light-sensitive material and the silver salt-receiving surface of the silver salt-fixing material are brought into contact, whereby the imagewise formed silver salt is transferred to the silver salt-fixing material in the presence of a hydrophilic thermal solvent according to a dry process of fixing the silver salt under a high temperature condition.

The movable silver salt-fixing layer contains a silver precipitant in a water-soluble binder.

The hydrophilic binder which can be used in the present invention typically includes transparent or semi-transparent hydrophilic colloids. These hydrophilic colloids include naturally-occurring substances, such as proteins, e.g., gelatin, gelatin derivatives, cellulose derivatives, polysaccharides, e.g., starch, gum arabic, dextrin, pullulan, etc.; and synthetic polymers, such as water-soluble polyvinyl compounds, e.g., polyvinyl alcohol, polyvinylpyrrolidone, acrylamide polymers, etc. Additional examples of the synthetic polymer compounds include dispersed vinyl compounds in the form of a latex that increase dimensional stability of photographic materials.

An especially preferred binder is regenerated cellulose. A silver salt-fixing layer containing a regenerated cellulose binder can be formed by a method comprising incorporating a silver precipitant in a cellulose ester, for example, cellulose diacetate, by vacuum evaporation, coating the mixture onto a support, and hydrolyzing the cellulose ester with an alkali; a method comprising reacting, for example, silver nitrate with sodium sulfide in a cellulose ester solution to produce a silver precipitant in situ, coating the mixture onto a support, and hydrolyzing the cellulose acetate with an alkali; a method comprising hydrolyzing a cellulose ester previously coated on a support with an alkali and at the same time burying a silver precipitant into the hydrolyzed layer; a method comprising alkalihydrolyzing a cellulose ester layer to produce regenerated cellulose and then reacting, for example, chloroauric acid with a reducing agent in the hydrolyzed layer to produce a silver precipitant; or a like method.

According to the present invention, the silver precipitant functions to reduce the transferred movable silver salt to silver and to fix it in the fixing layer.

Suitable examples of the silver precipitant can include heavy metals, such as iron, lead, zinc, nickel, cadmium, tin, chromium, copper and cobalt, and preferably noble metals, such as gold, silver, platinum and palladium. Additional examples of useful silver precipitants are sulfides and selenides of heavy metals, particularly a sulfide of mercury, copper, aluminum, zinc, cadmium, cobalt, nickel, silver, palladium, lead, antimony, bismuth, cerium or magnesium, and a selenide of lead, zinc, antimony or nickel. The functions of materials, such as silver precipitants, are described, e.g., in U.S. Pat. No. 2,774,667, etc.

As is known in the art, the silver precipitant is preferably used in a very small amount, for example, from about 1 to $25\times10^{-5}$ mol/m$^2$, usually in a lowest possible amount within this range. Higher concentrations of the silver precipitant out of the above-described range sometimes result in deposition of excessive silver or undesirable density of background in the highlight. A mixed silver precipitant may be used. Thus, an image-receiving layer can be substantially colorless and transparent in spite of the existence of precipitation nuclei.

For the purpose of increasing sensitivity and contrast or accelerating development, the photographic emulsion according to the present invention can contain, for example, polyalkylene oxides or derivatives thereof, e.g., ethers, esters and amides, thioether compounds, thiomorpholines, quaternary ammonium salt compounds, urethane derivatives, urea derivatives, imidazole derivatives, 3-pyrazolidones, and the like.

In the light-sensitive material in accordance with the present invention, the photographic emulsion layer or other hydrophilic colloidal layers can contain a water-soluble dye as a filter dye or for various purposes including prevention of irradiation. Such a water-soluble dye includes oxonol dyes, hemioxonol dyes, styryl dyes, merocyanine dyes, cyanine dyes and azo dyes, with oxonol dyes, hemioxonol dyes and merocyanine dyes being particularly useful. These dyes may be fixed in a specific layer by using a cationic polymer mordant, e.g., dialkylaminoalkyl acrylates.

In the light-sensitive material according to the present invention, when the hydrophilic colloidal layer contains a dye or an ultraviolet absorbent, such a layer may be mordanted by a cationic polymer.

Supports for the light-sensitive material and silver salt-fixing material according to the present invention are preferably made of high polymeric substances that are resistant to heat for development or silver salt movement.

Examples of the organic high polymers which can be used for the silver salt-fixing material as a support are polystyrene, polystyrene derivatives having a substituent having up to 4 carbon atoms, polyvinyl cyclohexane, polydivinylbenzene, polyvinylpyrrolidone, polyvinylcarbazole, polyallylbenzene, polyvinyl alcohol, polyacetals, e.g., polyvinyl formal and polyvinyl butyral, etc., polyvinyl chloride, chlorinated polyethylene, polytrichlorofluoroethylene, polyacrylonitrile, poly-N,N-dimethylacrylamide, polyacrylate having a p-cyanophenyl group, a pentachlorophenyl group and a 2,4-dichlorophenyl group, polyacrylchloroacrylate, polyesters, e.g., polymethyl methacrylate, polyethyl methacrylate, polypropyl methacrylate, polyisopropyl methacrylate, polyisobutyl methacrylate, poly-t-butyl methacrylate, polycyclohexyl methacrylate, polyethylene glycol dimethacrylate, poly-2-cyano-ethyl methacrylate, polyethylene terephthalate, etc., polysulfone, bisphenol A polycarbonate, polycarbonates, polyanhydrides, polyamides and cellulose acetates. These polymers have a molecular weight of from 2,000 to 85,000. Synthetic polymers described in J. Brandrup and E. H. Immergut (eds.), *Polymer Handbook*, 2nd Ed., John Willy and Sons are also useful. These high polymers can be used individually or in combinations of two or more thereof in the form of a copolymer.

Particularly useful supports are cellulose acetate films, e.g., triacetate, diacetate, etc., polyamide films prepared from a combination of heptamethylenediamine and terephthalic acid, fluorenedipropylamine and adipic acid, hexamethylenediamine and diphenic acid, hexamethylenediamine and isophthalic acid, or a like combination, a polyethylene terephthalate film, a polycarbonate film, and the like. These films may be modified. For example, polyethylene terephthalate films modified with cyclohexanedimethanol, isophthalic acid, methoxy polyethylene glycol, 1,2-dicarbomethoxy-4-benzenesulfonic acid, etc. are effective.

In the photographic light-sensitive material and silver salt-fixing material in accordance with the present invention, the phtotgraphic emulsion layer or other binder layers can contain an organic or inorganic hardener. Such an organic or inorganic hardener includes chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and the like, individually or in combination thereof.

Exposure can be effected by a wide variety of exposure means. A latent image can be obtained by image-wise exposure to radiation containing visible rays. Light sources for exposure generally include those commonly employed for color photography, such as a tungsten lamp, a mercury lamp, a halogen lamp, e.g., an iodine lamp, a xenon lamp, laser beams, a CRT, a luminescent lamp, an LED, etc.

Originals for printing may be either line originals, such as drafting, or photographic images with gradation. The light-sensitive material according to the present invention is also applicable to taking portraits or scenes by using cameras. Printing of an original can be carried out by contact printing, reflex printing or enlargement printing.

It is also possible that an image taken with a video camera, etc. or an image transmitted from a TV station can be directly transferred to a CRT or an FOT and the image can be focused on the heat-developable light-sensitive material by intimate contact with the CRT or FOT or through a lense, followed by printing.

Semiconductor laser beams having a luminescence peak at 700 nm or more or an infrared LED can also be employed as an exposure light source.

The heating step in accordance with the present invention can be effected all over the photographic material at a temperature of from about 80° C. to about 250° C. for a period of from about 0.5 to about 300 seconds. Low temperatures or high temperatures falling within the above temperature range may be employed by controlling the heating time. In particular, a temperature range of from about 110° C. to about 160° C. is useful. The heating can be performed by means of heat plates, an iron, heat rollers, and the like.

Further, heat rollers or heat plates having coated thereon a resistor can also be used as heating means, in which electric current is applied to heat the rollers or plates by Joule's heat.

Furthermore, a layer for resistance heating as described in Japanese Patent Application (OPI) No. 66442/73 may be coated on the reverse side of the heat-developable light-sensitive material of this invention, and heating is effected by applying current to the layer.

The present invention will now be illustrated in greater detail with reference to examples, but it should be understood that these examples are not meant to limit the present invention. In examples, all percents are given by weight unless otherwise indicated.

EXAMPLE 1

Preparation of Light-Sensitive Material N-1

Fourty grams of gelatin and 26 g of potassium bromide were dissolved in 3,000 ml of water, and the solution was stirred at 50° C. A solution of 34 g of silver nitrate in 200 ml of water was added to the above-prepared solution over a period of 10 minutes, and a solution of 3.3 g of potassium iodide in 100 ml of water was then added thereto over 2 minutes. The excess of salts was removed by sedimentation through pH adjustment, and the resulting emulsion was adjusted to a pH of 6.0 to prepare a silver iodobromide emulsion in a yield of 400 g.

In 3,000 ml of water were dissolved 28 g of gelatin and 13.2 g of benzotriazole, and the solution was stirred while maintaining the temperature at 40° C. To the resulting solution was added a solution of 17 g of silver nitrate in 100 ml of water over a period of 2 minutes. After the excess of salts was removed by sedimentation through pH adjustment, the resulting emulsion was adjusted to a pH of 6.0 to obtain 400 g of a silver benzotriazole emulsion.

A light-sensitive material (negative sheet) was produced as follows. The following components (a) to (d) were mixed and dissolved under heating, and the resulting solution was coated on a 180 μm thick polyethylene terephthalate film to a wet thickness of 80 μm:

| | |
|---|---|
| (a) Silver iodobromide emulsion | 20 g |
| (b) Silver benzotriazole emulsion | 20 g |
| (c) 1% Aqueous solution of sodium 2-ethylhexyl succinate sulfonate | 2 ml |
| (d) 1% Methanolic solution of 1-phenyl-3-pyrazolidone | 2 ml |

A solution consisting of the following components (a) to (c) was then coated on the light-sensitive emulsion layer to a wet thickness of 40 μm as a protective layer, to thereby produce a light-sensitive material (negative sheet) N-1.

Preparation of Silver Salt-Fixing Sheet (Positive Sheet)

A solution consisting of the following components (a) to (i) was coated on a white polyethylene terephthalate film containing titanium dioxide to a wet thickness of 60 μm, followed by drying, to prepare a positive sheet P-1:

| | |
|---|---|
| (a) 10% Aqueous solution of polyvinyl alcohol (polymerization degree: 500) | 20 g |
| (b) Urea | 3.2 g |
| (c) N—Methylurea | 4.8 g |
| (d) Water | 15 ml |
| (e) Ethanol | 5 ml |
| (f) Sodium thiosulfate (hypo) | 0.4 g |
| (g) 1-Phenyl-3-pyrazolidone | 0.4 g |
| (h) Colloidal silver sulfide dispersion (silver sulfide: 0.05 g) | 5 g |
| (i) 1% Aqueous solution of sodium 2-ethylhexyl succinate sulfonate | 2 ml |

The thus produced Light-Sensitive Material N-1 was exposed to light of 5,000 lx through a discontinuous wedge for 4 seconds using a tungsten lamp and brought into contact with Positive Sheet P-1. The combined unit was passed through heat rollers at 130° C. and then heated on a heating block for 60 seconds.

Immediately after heating, the positive sheet was peeled off. There was formed a blacky brown positive image on the positive sheet. The positive image was determined for the reflection density by the use of a self-recording densitometer and was found to have a minimum density of 0.31 and a maximum density of 1.36.

Negative Sheet N-2 was produced in the same manner as described above except that the silver benzotriazole emulsion was not used and, instead, 10 g of the silver iodobromide emulsion containing silver in an amount corresponding to the silver content of the silver benzotriazole emulsion as used in N-1 was added.

The resulting negative sheet N-2 was processed in the same manner as for N-1 to obtain a positive image having a minimum density of 0.3 and a maximum density of 0.60.

From the above-described results, it can be seen that a light-sensitive material using silver halides in combination with an organic silver salt has a conspicuously increased density of a transferred silver image, thus apparently indicating the effect of the present invention.

EXAMPLE 2

A solution of 50 g of silver nitrate in 400 ml of water and 400 ml of a solution having dissolved therein 19 g of potassium bromide and 8 g of sodium chloride were simultaneously added at a rate of 20 ml per minute to 800 ml of an aqueous solution containing 5 g of sodium chloride and 20 g of gelatin while being maintained at 55° C. The pH of the mixture was adjusted and a precipitant was added thereto thereby to remove any unnecessary salts, and the resulting mixture was adjusted to a pH of 6.3. Thereafter, 5 ml of a 0.01% solution of trimethylthiourea was added thereto, and the mixture was allowed to stand at 55° C. for 30 minutes to effect sulfur sensitization to prepare a silver chlorobromide emulsion in a yield of 500 g.

Negative Sheet N-3 was produced in the same manner as described for N-1 in Example 1 except for using the above-prepared silver chlorobromide emulsion in place of the silver iodobromide emulsion as used for N-1.

Negative Sheet N-4 was produced in the same manner as described for N-1 in Example 1 except for using 40 g of the silver chlorobromide emulsion in place of 20 g of the silver iodobromide emulsion (a) and 20 g of the silver benzotriazole emulsion (b).

Negative Sheet N-5 was produced in the same manner as described for N-1 in Example 1 except for using no 1-phenyl-3-pyrazolidone (g).

Each of the resulting negative sheets N-3 to N-5 was processed in the same manner as in Example 1.

As a result, it was found that black positive images having $D_{max}/D_{min}$ of 1.58/0.33, 1.00/0.38 and 1.28/0.40 were formed on Negative Sheets N-3, N-4 and N-5, respectively.

The above results clearly demonstrate the effect of the present invention which is exerted by the copresence of an organic silver salt oxidizing agent in a silver chlorobromide emulsion. It was also proved that the objects of the present invention can be achieved with a reducing agent in a silver salt-fixing material (positive sheet) even if a light-sensitive material (negative sheet) contains no reducing agent.

While the invention has been described in detail and with reference to specific embodiments thereof, it will be apparent to one skilled in the art that various changes and modifications can be made therein without departing from the spirit and scope thereof.

What is claimed is:

1. A method for forming a silver image which comprises imagewise exposing and heating a heat-developable light-sensitive material containing a light-sensitive silver halide and an organic silver salt oxidizing agent to result in exposed and unexposed silver halide, the imagewise exposing and heating resulting in the imagewise production of a moveable silver salt in the presence of a reducing agent and a silver halide solvent, the reducing agent being present in an amount of from about 0.1 to about 20 mols per mol of the total amount of the silver halide and organic silver salt oxidizing agent, said unexposed silver halide reacting with said silver halide solvent to form said movable silver salt and said movable silver salt then diffusing due to said heating to a silver salt fixing layer comprising a silver precipitate to form a silver image corresponding to said movable silver salt.

2. A method as in claim 1, wherein the silver halide solvent is present in an amount of from 1/20 to 20 mols per mol of silver coverage.

3. A method as in claim 2, wherein the silver halide solvent is present in an amount of from 1/10 to 10 mols per mol of silver coverage.

4. A method as in claim 1, wherein there is further present a hydrophilic thermal solvent.

5. A method as in claim 4, wherein the hydrophilic thermal solvent has a melting point of from 40° to 250° C.

6. A method as in claim 5, wherein the hydrophilic thermal solvent has a melting point of from 40° to 200° C.

7. A method as in claim 6, wherein the hydrophilic thermal solvent has a melting point of from 40° to 150° C.

8. A method as in claim 4, wherein the hydrophilic thermal solvent has a molecular weight of about 200 or less.

9. A method as in claim 8, wherein the hydrophilic thermal solvent has a molecular weight of about 100 or less.

10. A method as in claim 4, wherein the hydrophilic thermal solvent is present in an amount of from 5 to 500% by weight based on the total coverage of the light-sensitive material.

11. A method as in claim 10, wherein the hydrophilic thermal solvent is present in an amount of from 20 to 200% by weight based on the total coverage of the light-sensitive material.

12. A method as in claim 11, wherein the hydrophilic thermal solvent is present in an amount of from 30 to 150% by weight based on the total coverage of the light-sensitive material.

* * * * *